US006016093A

United States Patent [19]

Grubben et al.

[11] Patent Number: 6,016,093

[45] **Date of Patent: *Jan. 18, 2000**

[54] DEFLECTION UNIT INCLUDING A LINE BALANCE COIL

[75] Inventors: Antonius P. M. Grubben; Jacobus J. M. Van De Meerakker, both of Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/656,148

[22] Filed: May 31, 1996

[30] Foreign Application Priority Data

Jun. 9, 1995 [EP] European Pat. Off. ..... 95201527

[51] Int. Cl.[7] ..... H01F 7/00

[52] U.S. Cl. ..... 335/210; 335/213; 313/440; 315/370

[58] Field of Search ..... 335/210–213; 313/440; 315/370

[56] References Cited

U.S. PATENT DOCUMENTS

| | | | |
|---|---|---|---|
| Re. 35,183 | 3/1996 | Ose et al. | 315/370 |
| 4,470,029 | 9/1984 | Chase | 335/210 |
| 4,833,432 | 5/1989 | Ohtsu et al. | 335/212 |
| 5,115,170 | 5/1992 | Ose et al. | 315/370 |
| 5,119,056 | 6/1992 | Itoh et al. | 335/213 |

FOREIGN PATENT DOCUMENTS

| | | |
|---|---|---|
| 5-21017 | 1/1993 | Japan . |
| 6-153000 | 5/1994 | Japan . |
| 7-029514 | 1/1995 | Japan . |
| 07226943 | 8/1995 | Japan . |

*Primary Examiner*—Michael L. Gellner
*Assistant Examiner*—Tuyen Nguyen
*Attorney, Agent, or Firm*—Robert J. Kraus

[57] ABSTRACT

A deflection unit having a hollow synthetic material coil support within which a line deflection coil system is arranged, which line deflection coils are connected in an electric circuit to a line balance coil arrangement comprising a cylinder which is provided with two sub-coils and within which a magnet core is movably arranged. The coil cylinder is secured to the coil support and is provided with an arrangement of metal (connection) strips which ensure a direct connection between the balance coil lead-outs, the line deflection coils and a tap.

17 Claims, 6 Drawing Sheets

DEFLECTION UNIT INCLUDING A LINE BALANCE COIL

BACKGROUND OF THE INVENTION

This invention relates to a deflection unit within which a line deflection coil system is arranged, said line deflection coils being connected in an electric circuit to a line balance coil arrangement comprising a cylinder which is provided with two sub-coils and within which a magnet core is arranged.

In deflection units for cathode ray tubes, such as display tubes, and particularly monitor tubes and television tubes, line balance coils are used to control the selfinduction balance between the two line deflection coils. To this end, they are incorporated in a circuit with the line deflection coils. The line deflection coils are preferably arranged within a hollow synthetic material coil support.

The conventional line balance coil comprises two sub-coils wound on a cylinder. The cylinder is an injection-moulded product of polycarbonate in which 4 wires are moulded, while at one end the coil is sealed and at the other end the wire is inserted into a PCB (Printed Circuit Board) and soldered. The PCB has "riveting bushes" which are used for security purposes. The PCB is the connection between contact pins G, H of the line balance coil and the contact pins A, D to which the line deflection coils are connected. The PCB also ensures the connection between the line balance coil and the client connection E. The other client connection is B or C (see FIGS. 1, 2 and 4). In practice, these types of line balance coil-PCB constructions present problems which may even lead to fire. According to the invention, these problems are related to differences in expansion between PC (polycarbonate) of the coil cylinder and the PCB material, while the mode of establishing electrical contact via wires soldered in riveting bushes is not optimal.

SUMMARY OF THE INVENTION

The deflection unit according to the invention, which obviates the abovedescribed drawbacks and various other drawbacks of the state of the art, is characterized in that the coil cylinder is provided with an arrangement of metal (connection) strips which ensure a direct connection between the balance coil lead-outs, the line deflection coils and a tap.

The essence of the invention is that the PCB is omitted and the functions of the PCB are integrated in the line balance coil. This means that a direct connection can be established between the line deflection coil and the line balance coil. It does not need to be established via tracks on a PCB. In practice, this may be realized by integrating the contact between D and H in one pin, integrating the contact between A and G in one pin, integrating the contact F, I and E in one pin and integrating the contact B-C in one pin. These pin shapes are preferably punched from a "leadframe" which is enveloped in a mould and punched loose. Various bends may be formed in the mould. The pin shapes have the properties required to fasten the coils and to connect to other circuits. The position of the client connections is not fixed. Various positions are possible.

Integration in the line balance coil of the sealing pins and the function of the PCB lead to the following advantages:

no problems caused by differences of expansion no risk of fire mode of establishing contact is more secure no PCB and riveting bushes required no PCB punching tools required no pin insertion tools required no riveting tools required no "expensive" PCB in the design stage integrally cheaper more friendly to the environment.

In a preferred embodiment the coil cylinder is provided with a plurality of supporting members which are integrated with an arrangement of metal (connection) strips formed from a leadframe. The supporting members are preferably made of an insulating material. In particular, they are moulded from a synthetic material.

In a further embodiment a plurality of supporting members extends transversely to the longitudinal axis of the cylinder.

In a variant of the previous embodiment the supporting members extend in a plane parallel to the longitudinal axis of the coil cylinder and are secured to the cylinder via flanges extending transversely to the longitudinal axis of the cylinder. The line balance coil arrangement is preferably secured to the coil support of the deflection coils. It may be integrated with a special holder in which the arrangement may be clamped. This is a practical system for every embodiment. The magnet core in the coil cylinder is preferably movably arranged.

The invention also relates to a practical method of producing line balance coils.

BRIEF DESCRIPTION OF THE DRAWING

These and other aspects of the invention will be apparent from and elucidated with reference to the embodiments described hereinafter.

In the drawings.

DESCRIPTION OF THE PREFERRED EMBODIMENTS

Figure 3:
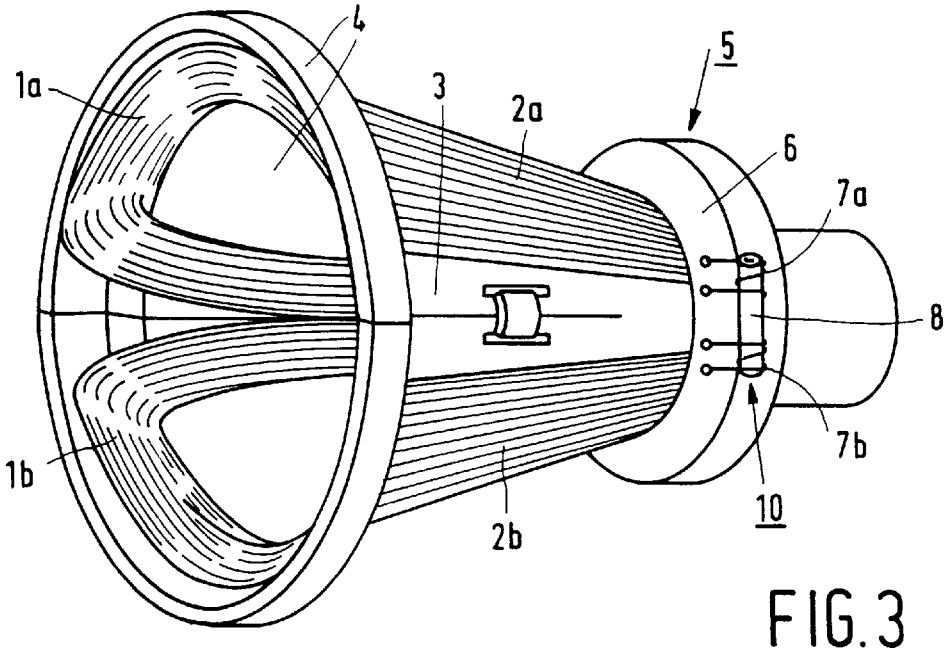
FIG. 3 is a perspective elevational view of an embodiment of a deflection unit according to the invention.

FIG. 3 shows an embodiment of a deflection unit 5 (deflection yoke) comprising a pair of line deflection coils

1*a*, 1*b*, a pair of field deflection coils 2*a*, 2*b*, in this case wound on a ferrite ring core 3, and a hollow coil support 4 (support frame) of synthetic material.

The deflection unit 5 is provided with a line balance coil arrangement 10 comprising a coil cylinder 8 on which two line balance sub-coils 7*a*, 7*b* are arranged. The coil cylinder 8 is secured to a rear flange 6 of the coil support 4.

Figure 1:
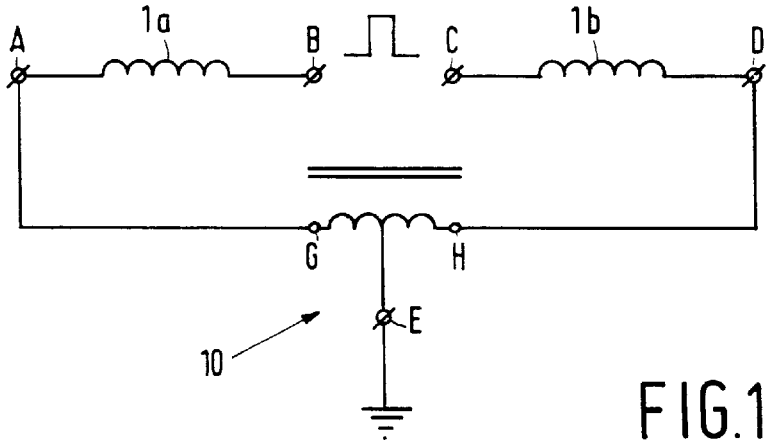
FIG. 1 is an electric circuit diagram of a circuit of line deflection coils and a line balance coil.
Figure 2:
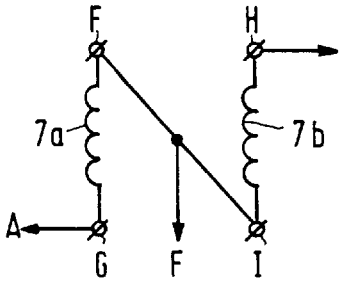
FIG. 2 is an electric circuit diagram of a line balance coil.

Line deflection coil 1*a* has connections A and B, line deflection coil 1*b* has connections C and D and the line deflection coils 1*a*, 1*b* are arranged in an electric circuit with the line balance coil 10 in the manner as shown in FIG. 1. The electric circuit diagram of the line balance coil 10 is shown in FIG. 2. Line balance sub-coil 7*a* has connections F and G and line balance sub-coil 7*b* has connections H and I.

Figure 4:
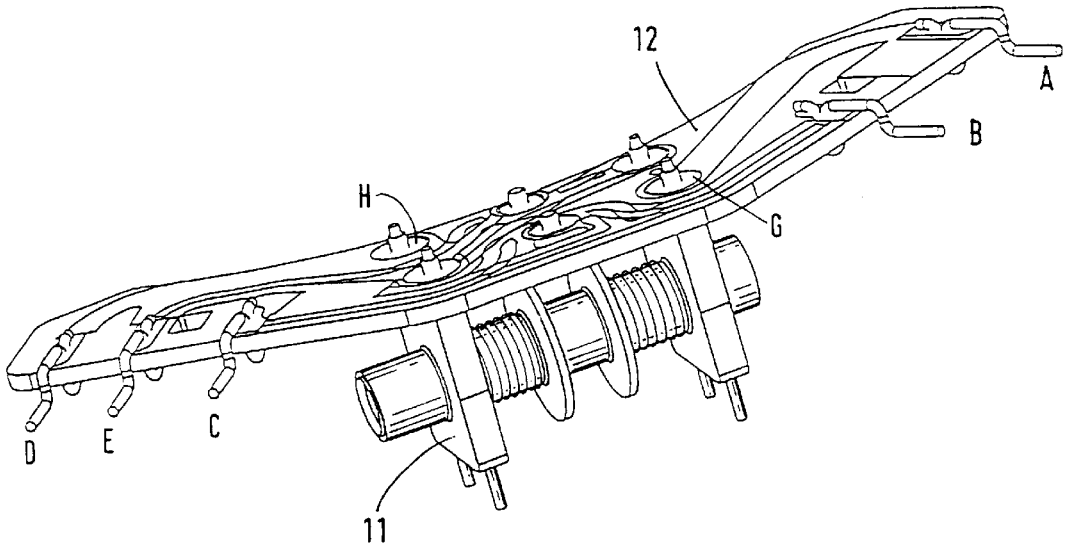
FIG. 4 is a perspective elevational view of a line balance coil mounted on a PCB in accordance with the state of the art.

FIG. 4 shows a conventional line balance coil arrangement 11 mounted on a PCB 12.

In contrast, the connections (sealing pins) and the function of the PCB are integrated, in accordance with the invention, in the line balance coil.

Figure 5:
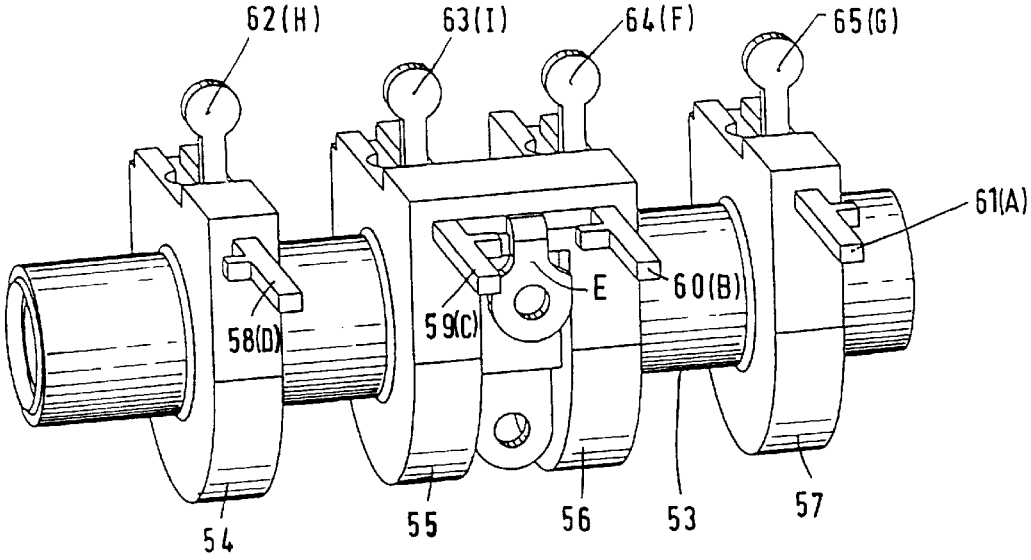
FIG. 5 is a perspective elevational view of an embodiment of a line balance coil arrangement without coils according to the invention.

FIG. 5 shows a first embodiment. Coil cylinder 53 has 4 cross-flanges 54–57 in which connection strips 58–61 are integrated. These are formed in a manner to be described hereinafter from a leadframe which is enveloped with synthetic material in a mould. In this case, the connection strips 58–61 have bent ends 62–65 intended to fasten the ends of the line balance sub-coils to be wound between the flanges 54–55 and the flanges 56 and 57.

Figure 6:
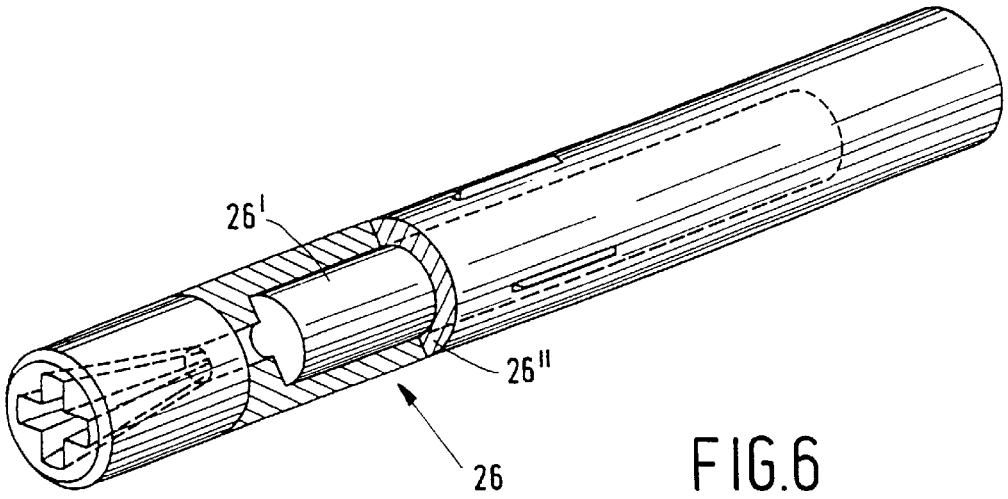
FIG. 6 shows diagrammatically an adjustable magnetic core arrangement for use in a line balance coil.

The coil cylinder 53 is hollow and intended to comprise a self-tapping control core assembly 26 which is movable in the longitudinal direction and is of the type shown in FIG. 6. (The ferrite magnet core is denoted by the reference numeral 26', the synthetic envelope having a tapered cross-shaped recess is denoted by 26".)

Figure 7:
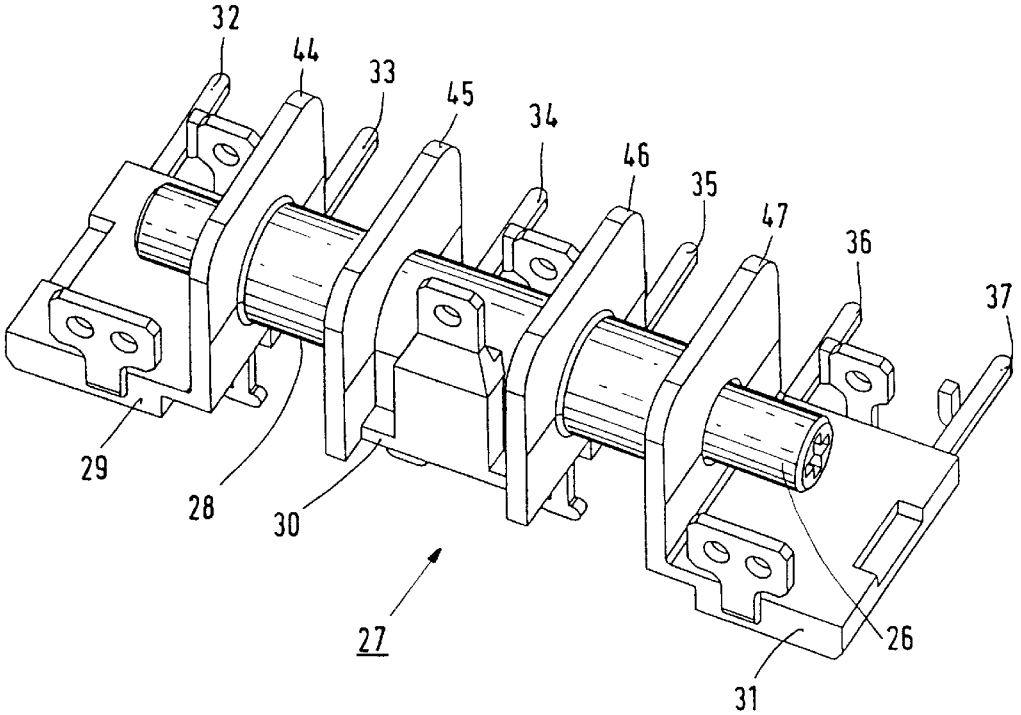
FIG. 7 is a perspective plan view and FIG. 8 is a perspective bottom view of an embodiment of a line balance coil arrangement according to the invention, with an adjustable magnet core but without coils.
Figure 8:
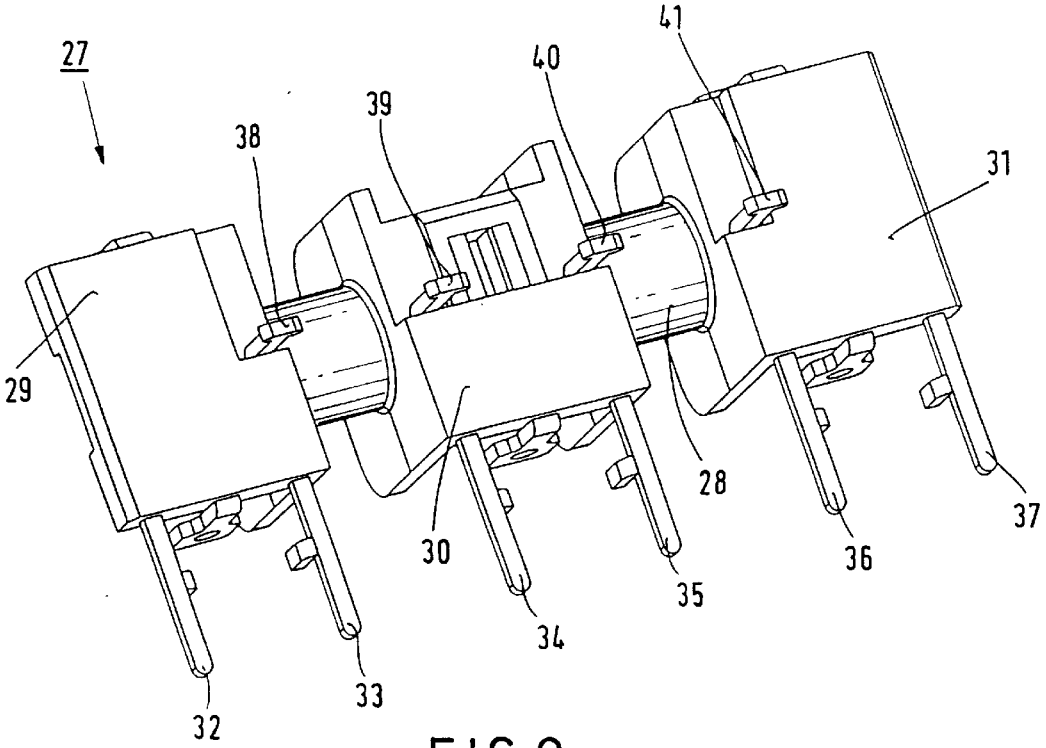

FIG. 7 shows an alternative embodiment of a line balance coil arrangement 27 in which a magnet core 26 (enveloped with synthetic material) is arranged in a coil cylinder 28. Arrangement 27 has four synthetic material cross-flanges 44–47 to which three synthetic material supporting members 29–31 are secured which extend parallel to the longitudinal axis of cylinder 28. As is shown in FIG. 8, metal connection strips 32–37 are integrated with the supporting members 29–31, which strips have bent ends 38–41 intended to secure the ends of the line balance sub-coils to be wound between the flanges 44 and 45 and the flanges 46 and 47.

Figure 9:
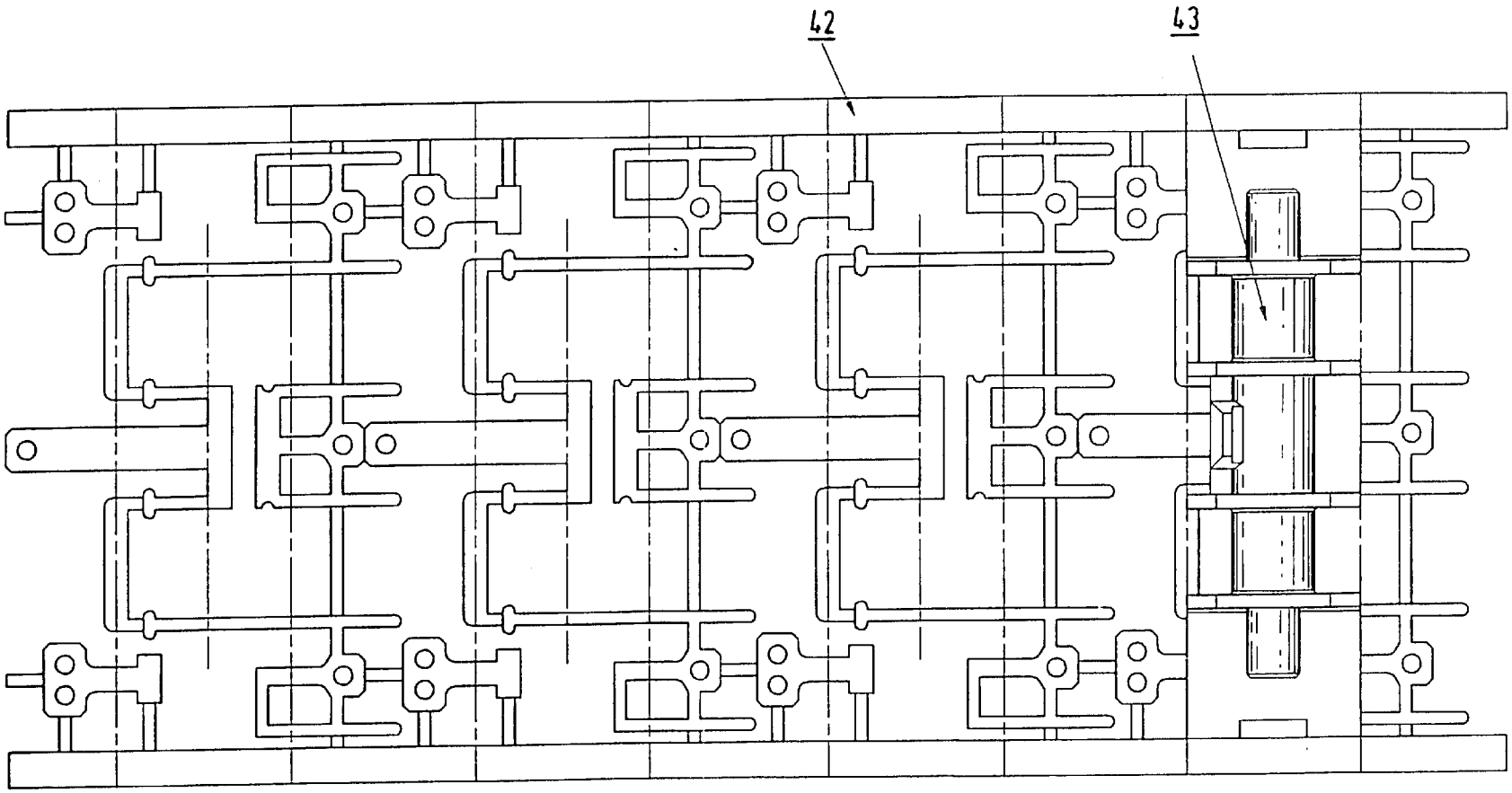
FIG. 9 is a plan view of a sheet of strip material having a repetitive pattern of connection strips and being combined with a coil cylinder arrangement of the type as shown in FIGS. 7 and 8.

FIG. 9 is an elevational view of a sheet of strip material 42 in which a repetitive pattern of coherent connection strips, to be punched loose at a later stage is formed, for example by means of etching. The Figure particularly shows how such a sheet with a connection strip pattern is joined with a line balance coil 43. By enveloping the strip pattern with a synthetic material, punching loose and bending of the connection strips, the construction shown in FIGS. 7 and 8 is obtained. In its turn, this construction is secured to the coil support of a deflection unit and the connections intended for this purpose are connected to the lead-outs of the line deflection coils and to ground. Securing may be realized in different manners, for example, by means of synthetic material supports secured to the coil support. In "double mussel" deflection units, it is practical to secure the line balance coil to the front flange of the coil support, in contrast to securing it to the rear flange (cf. FIG. 3) as is common practice in hydride coils.

Figure 10:
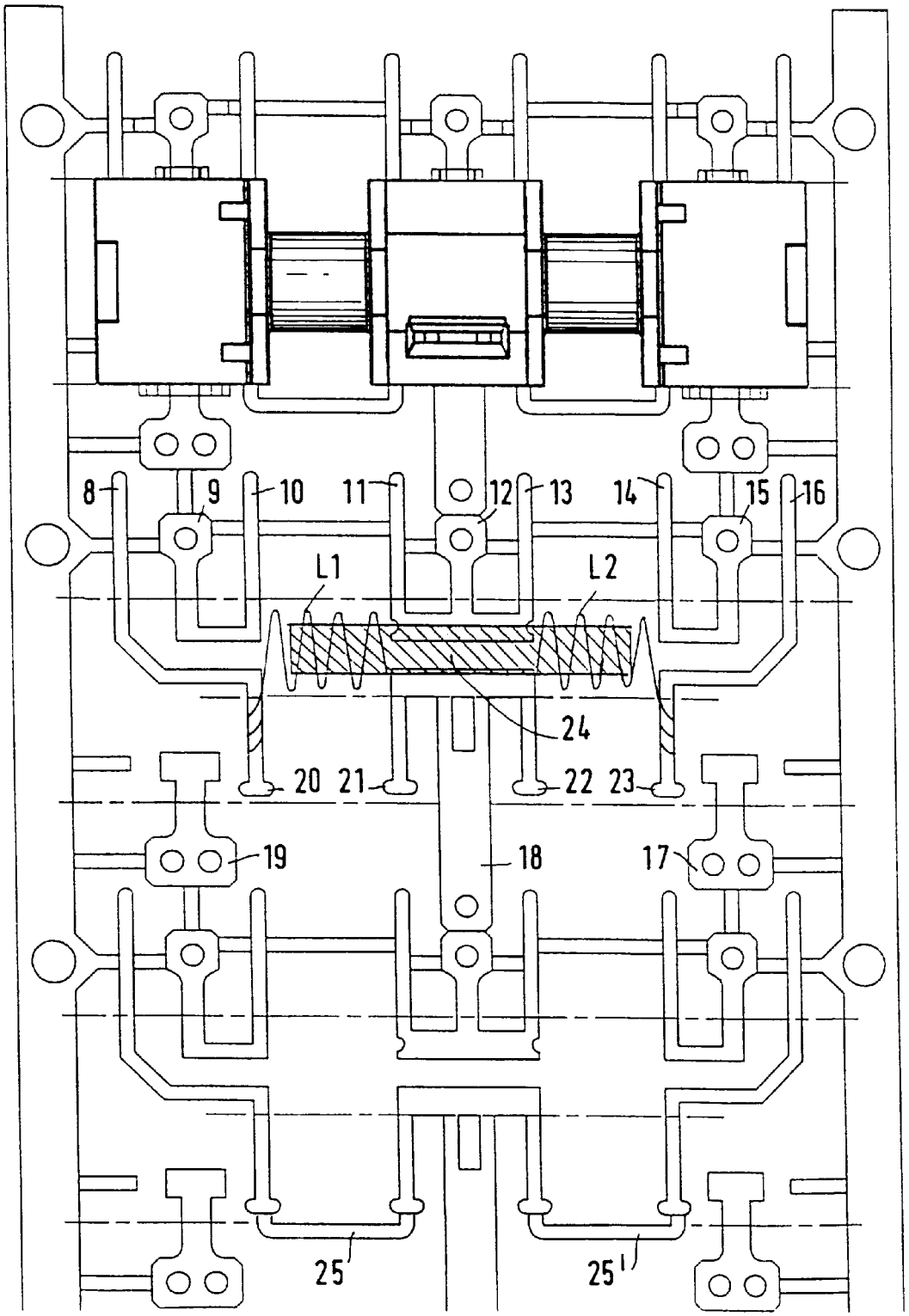
FIG. 10 is a plan view of a sheet having an alternative pattern of connection strips, combined with line balance sub-coils shown diagrammatically.

Various options can be realized with the novel line balance coil design as shown in FIG. 10:

1.

Line balance control.

The end lead-outs of the line deflection coil are sealed to the pins 11 and 13.

The start lead-outs of the line deflection coil are sealed to the pins 8 and 16.

Coil L1 is wound between the pins 20 and 21,

Coil L2 is wound between the pins 22 and 23.

A controllable ferrite core is inserted into the line balance coil.

2.

Line balance control using ringing damping.

Similarly as option 1 with a tap drawn from the line deflection coil (via a winding process or welded) and sealed to pin 10 for the one line deflection coil and pin 14 for the other line deflection coil.

A resistor is connected between pin 10 and pin 9 and between pin 14 and pin 15.

A capacitor is connected between pin 9 and pin 8 and between pin 15 and pin 16.

The resistor and the capacitor may also be interchanged because they are in series.

3.

Line balance control using ringing damping and VLMF (Very Low Magnetic Field, shielding of magnetic fields from within the tube).

Similarly as options 1 and 2 with VLMF connection to pin 18 via a coil (PCB mould or loosely wound) connected to pin 17 or 19.

Figure 11A:
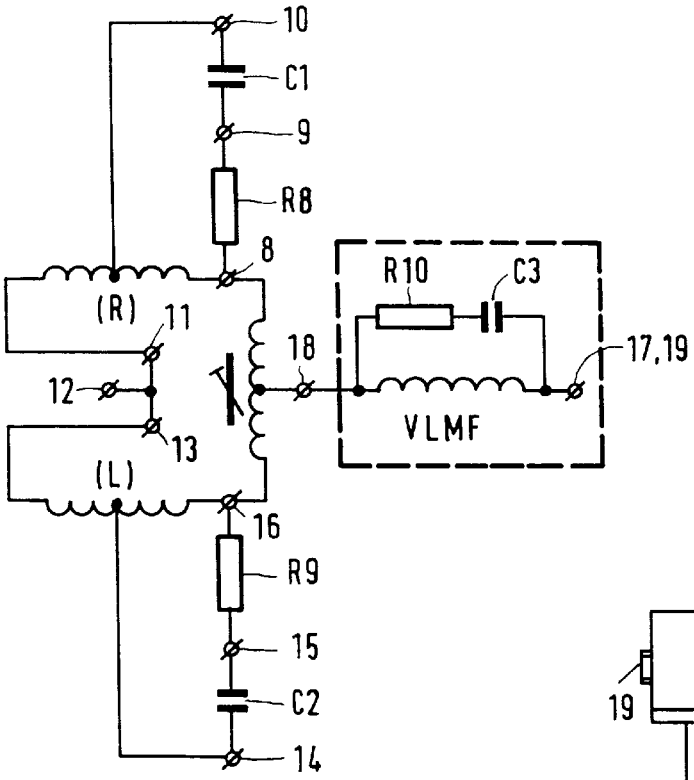
FIG. 11A shows a circuit diagram and FIG. 11B is an elevational view of the construction showing the connection of line deflection coils, taps from the line deflection coils, a line balance coil and possible further features.
Figure 11B:
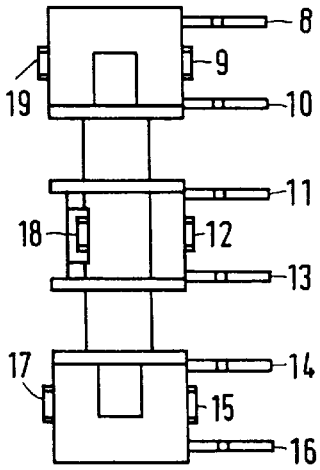

The circuit diagram is shown in FIG. 11A while FIG. 11B is a plan view of the line balance coil with connection pins.

4.

No line balance control.

The end lead-outs of the line deflection coil are sealed to the pins 11 and 13.

The start lead-outs of the line deflection coils are sealed to the pins 8 and 16.

Connection pieces 25 and 25' are not cut loose. The coils L1 and L2 are thus not wound and the ferrite core is not provided.

5.

It will be evident that various other combinations based on these 4 options are possible.

It is particularly possible to realize other connection patterns as desired by interchanging the leadframes in a mould.

In summary, the invention thus relates to a deflection unit having a hollow synthetic material coil support within which a line deflection coil system is arranged, which line deflection coils are connected in an electric circuit to a line balance coil arrangement comprising a cylinder which is provided with two sub-coils and within which a magnet core is movably arranged. The coil cylinder is secured to the coil support and is provided with an arrangement of metal (connection) strips which ensure a direct connection between the balance coil lead-outs, the line deflection coils and a tap.

What is claimed is:

1. A deflection unit including a line, deflection coil system having line deflection coils connected in an electric circuit to a line balance coil arrangement comprising a coil cylinder which is provided with two sub-coils and balance coil lead-outs and within which a magnet core is arranged, wherein the coil cylinder comprises an arrangement of bent metal connection strips which provide a direct connection between the balance coil lead-outs, the line deflection coils and a tap, said coil cylinder further comprising a plurality of supporting members which are integrated with the arrangement of metal connection strips which are formed from a lead frame.

2. A deflection unit including a line deflection coil system having line deflection coils connected in an electric circuit to a line balance coil arrangement comprising a coil cylinder which is provided with two sub-coils and balance coil lead-outs and within which a magnet core is arranged, wherein the coil cylinder comprises an arrangement of metal connection strips which provide a direct connection between the balance coil lead-outs, the line deflection coils and a tap, said coil cylinder further comprising a plurality of supporting members which are integrated with the arrangement of metal connection strips which are formed from a lead frame, said supporting members extending transversely to the longitudinal axis of the coil cylinder.

3. A deflection unit including a line deflection coil system having line deflection coils connected in an electric circuit to a line balance coil arrangement comprising a coil cylinder which is provided with two sub-coils and balance coil lead-outs and within which a magnet core is arranged, wherein the coil cylinder comprises an arrangement of metal connection strips which provide a direct connection between the balance coil lead-outs, the line deflection coils and a tap, said coil cylinder further comprising a plurality of supporting members which are integrated with the arrangement of metal connection strips which are formed from a lead frame, said supporting members extending parallel to the longitudinal axis of the coil cylinder and being secured to the coil cylinder via flanges extending transversely to the longitudinal axis of the coil cylinder.

4. A deflection unit as claimed in claim 3, wherein the coil cylinder comprises four cross-flanges, the outer one of which is secured to two supporting members facing away from each other and the inner one is secured to a third supporting member, and a sub-coil is wound on the coil cylinder between each one of the outer pairs of cross-flanges.

5. A deflection unit comprising:

a line deflection coil system including two line deflection coils each having first and second wire connection leads, a line balance coil arrangement comprising a coil cylinder within which is an adjustable magnet core, two, sub-coils having lead-out wires, and an arrangement of conductive connection elements, wherein the line deflection coils are coupled to the sub-coils of the line balance coil by direct connection of respective wire connection leads of the line deflection coils and respective lead-out wires of said sub-coils to corresponding respective conductive connection elements of the line balance coil.

6. The deflection unit as claimed in claim 5 wherein respective taps of the line deflection coils are directly connected to other ones of said conductive connection elements of the line balance coil.

7. The deflection unit as claimed in claim 6 wherein at least one other one of said conductive connection elements has three ends, the two outer ends being secured to respective lead-out wires of the sub-coils and a central end being secured to the tap of a respective line deflection coil.

8. The deflection unit as claimed in claim 5 wherein the line deflection unit is devoid of a printed circuit board for making said direct connections between the line deflection coils and the sub-coils of the line balance coil.

9. The deflection unit as claimed in claim 5 wherein the line balance coil comprises a plurality of support members secured to the coil cylinder and to which said conductive connection elements are integrated.

10. The deflection unit as claimed in claim 6 further comprising at least one resistor and one capacitor directly connected in series circuit between at least one other one of said conductive connection elements and one of said corresponding respective conductive connection elements of the line balance coil arrangement.

11. A deflection unit comprising:

a line deflection coil system including two line deflection coils each having first and second wire connection leads, a line balance coil arrangement comprising first and second sub-coils having lead-out wires, an adjustable magnet core disposed at least partially within said sub-coils, and an arrangement of conductive connection elements, wherein the line deflection coils are coupled to the first and second sub-coils by direct connection of respective wire connection leads of the line deflection coils and respective lead-out wires of said sub-coils to corresponding respective conductive connection elements of the line balance coil.

12. A deflection unit as in claim 11 wherein respective taps of the line deflection coils are directly connected to other ones of said conductive connection elements of the line balance coil arrangement.

13. A deflection unit as in claim 12 wherein at least one other one of said conductive connection elements has three ends, the two outer ends being secured to respective lead-out wires of the sub-coils and a central end being secured to the tap of a respective line deflection coil.

14. A deflection unit as in claim 11 wherein the line deflection unit is devoid of a printed circuit board for making said direct connections between the line deflection coils and the sub-coils of the line balance coil arrangement.

15. A deflection unit as in claim 11 wherein the line balance coil arrangement comprises a plurality of support members secured to the coil cylinder and with which said conductive connection elements are integrated.

16. A deflection unit as claim 12 comprising at least one resistor and one capacitor directly connected in series circuit between at least one other one of said conductive connection elements and one of said corresponding respective conductive connection elements of the line balance coil arrangement.

17. A deflection unit as in claim 11 where a coil support is provided for the deflection unit and the line balance coil arrangement is directly secured to said coil support without the interposition of a printed circuit board.

* * * * *